US006263186B1

(12) United States Patent
Okamoto et al.

(10) Patent No.: US 6,263,186 B1
(45) Date of Patent: Jul. 17, 2001

(54) IMAGE FORMING APPARATUS AND CONVEYANCE CONTROL METHOD THEREOF

(75) Inventors: Akira Okamoto; Norio Joichi; Hiroyuki Watanabe; Hideo Yamane; Youbao Peng, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/535,730

(22) Filed: Mar. 27, 2000

(30) Foreign Application Priority Data

Mar. 31, 1999 (JP) ..... 11-091656
Mar. 31, 1999 (JP) ..... 11-091657

(51) Int. Cl.[7] ..... G03G 15/00
(52) U.S. Cl. ..... 399/388; 271/188; 271/242
(58) Field of Search ..... 399/388, 390, 399/394, 395, 36, 75; 271/182, 188, 242, 266

(56) References Cited

U.S. PATENT DOCUMENTS 5,085,420 * 2/1992 Sata ..... 271/242 X
5,201,424 * 4/1993 Hain ..... 271/188 X
5,543,909 * 8/1996 Quesnel ..... 399/394
5,738,349 * 4/1998 Shirasaki ..... 271/242
6,092,803 * 7/2000 Munenaka ..... 271/242

* cited by examiner

*Primary Examiner*—Sophia S. Chen
(74) *Attorney, Agent, or Firm*—Jordan B. Bierman; Bierman, Muserlian and Lucas

(57) ABSTRACT

An image forming apparatus includes: a sheet feeding member for feeding a recording material; an image recording member for recording an image on the recording material; a conveyance path connecting the sheet feeding member and the image recording member, along which the recording material is conveyed; a registration member which is provided in the conveyance path located at the upstream side of the image recording member in the conveyance direction for the recording material, and stops the leading edge of the recording material when being hit by the leading edge, and then, starts conveyance of the recording material; a loop forming member which is provided in the conveyance path located at the upstream side of the registration member in the conveyance direction for the recording material, and forms a loop on the recording material which is stopped by the registration member; a first driving source for driving the registration member; a second driving source for driving the loop forming member; and a drive controller for controlling the first driving source and the second driving source. The drive controller drives both the first driving source and the second driving source after the leading edge of the recording material hits the registration member.

14 Claims, 9 Drawing Sheets

PRIOR ART
M1
M2
LOOP FORMING ROLLERS
REGISTRATION ROLLERS
FIG. 6 ( a )
FIG. 6 ( b )
FIG. 6 ( c )
FIG. 6 ( d )

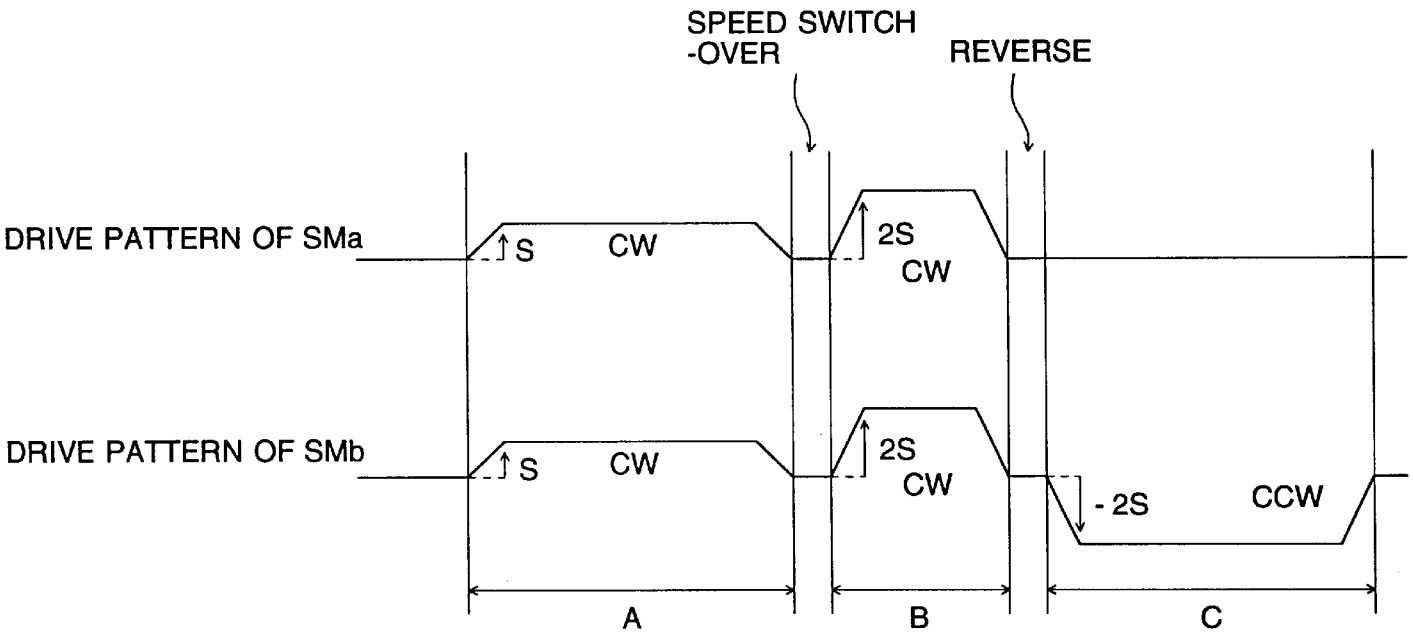
FIG. 9 ( a )
FIG. 9 ( b )

IMAGE FORMING APPARATUS AND CONVEYANCE CONTROL METHOD THEREOF

BACKGROUND OF THE INVENTION

The present invention relates to an image forming apparatus and a conveyance control method for the image forming apparatus, and in particular, to control in the case of conveying a transfer sheet at high speed.

In an image forming apparatus such as a copying machine, a printer and a facsimile machine, importance has been attached to a period of time from the start of copying processing to output of the first copy sheet (first copy time) and to the number of copy sheets outputted within a unit time.

To improve these functions, it is preferable that a transfer sheet is conveyed continuously without stagnation inside the image forming apparatus.

In the case of an image forming apparatus of an electrophotographic system, therefore, the preferable is an image forming apparatus wherein a transfer sheet passes through a registration roller, a photoreceptor drum and a fixing roller at the ordinary second conveyance speed, and conveyance from a sheet feeding tray and conveyance for sheet-reversing and sheet-refeeding are conducted at the first conveyance speed which is twice the second conveyance speed.

The state of an image forming apparatus as that stated above is shown in FIG. 5. When conducting conveyance by switching to plural conveyance speeds as stated above, speeds are switched by the use of a clutch mechanism, in loop forming rollers 182 arranged at the conveyance path on the upstream side of registration rollers 185 which rotate at constant speed.

Namely, the loop forming roller 182 conveys transfer sheet "p" at the first speed in the case of sheet feeding from a sheet-feeding tray and of conveyance for sheet-reversing and sheet-refeeding, but when the transfer sheet "p" is interposed by both the registration rollers 185 and the loop forming rollers 182 to be conveyed, the loop forming rollers 182 convey the transfer sheet "p" at the second conveyance speed which is the same as that of the registration rollers 185.

In this case, in the loop forming rollers 182 which use plural conveyance speeds for conveying, magnetic clutch C1 is turned on first to transmit torque coming from driving source M1 to the loop forming rollers 182 (FIG. 6(*a*), (*c*)), and then, magnetic clutch C2 is turned on to transmit torque coming from driving source M2 to the loop forming rollers 182 (FIG. 6(*b*), (*c*)). Incidentally, in the period of time when the magnetic clutch C2 is turned on, the registration rollers are also driven by M2 simultaneously (FIG. 6(*d*)).

The control of this kind is not limited to an image forming apparatus of an electrophotographic system, but it is a structure which can be applied generally to an image forming apparatus having the structure to convey a recording material to an image recording position, such as that of an ink jet system.

However, when a clutch mechanism is used for switching conveyance speeds, switching time and response time are needed. When an ordinary magnetic clutch is used, there is response dispersion of about 50 milliseconds. Because of existence of this response dispersion, an interval of conveyance for transfer sheets needs to be lengthened, which has checked high speed operations.

When the number of speeds is n, magnetic clutches in quantity of n or (n−1) are required.

When the number of plural conveyance paths such as sheet-feeding cassette and bypass sheet-cassette is m, the number of magnetic clutches required is n×m or (n−1)×m.

For the reasons stated above, there are caused problems of increased number of parts and lowered reliability, and a problem of lowered high speed nature.

When conducting conveyance by switching two speeds as stated above, a conveyance roller arranged immediately before a registration roller which rotates at a constant speed is changed in terms of speed by a clutch mechanism.

However, when the clutch mechanism is used, a period of time for switching and a response time are needed. Further, when conveying a transfer sheet by interposing it with two conveyance rollers, slight disagreement of response time between the two conveyance rollers causes troubles such as overload for a driving source, damage of a transfer sheet and occurrence of abnormal noise both caused by rubbing between the transfer sheet and the conveyance roller.

For preventing these troubles, there has been employed a method to provide a difference between gripping forces of two conveyance rollers when a transfer sheet is interposed by the two conveyance rollers, or a method to give excessive slack to a transfer sheet interposed by two conveyance rollers.

However, giving slack to a transfer sheet between two conveyance rollers creates waste of time for conveyance of the transfer sheet, which has checked high speed operations slightly.

Further, even in the case of the method to provide a difference between gripping forces of two conveyance rollers, it has been difficult for this method to prevent overload for the driving source, damage on a transfer sheet and occurrence of abnormal noise completely.

SUMMARY OF THE INVENTION

Therefore, the first object of the invention is to realize an image forming apparatus and a conveyance control method for the image forming apparatus wherein no dispersion of response time is caused in a simple structure when conveying a transfer sheet by the use of a loop forming roller.

The second object of the invention, therefore, is to realize an image forming apparatus and a conveyance control method for the image forming apparatus wherein a difference between gripping forces of two conveyance rollers and a slack of a transfer sheet are not necessary, and overload for the driving source, damage of the transfer sheet and occurrence of abnormal noise are not caused.

Structures for attaining the objects stated above are as follows.

(First Structure) An image forming apparatus includes: a sheet feeding member for feeding a recording material; an image recording member for recording an image on the recording material; a conveyance path connecting the sheet feeding member and the image recording member, along which the recording material is conveyed; a registration member which is provided in the conveyance path located at the upstream side of the image recording member in the conveyance direction for the recording material, and stops the leading edge of the recording material when being hit by the leading edge, and then, starts conveyance of the recording material; a loop forming member which is provided in the conveyance path located at the upstream side of the registration member in the conveyance direction for the recording material, and forms a loop on the recording material which is stopped by the registration member; a first driving source for driving the registration member; a second driving source for driving the loop forming member; a drive control means for controlling the first driving source and the second driving source. The drive control means drives both the first driving source and the second driving source after the leading edge of the recording material hits the registration member.

(Second Structure) A drive control method for an image forming apparatus includes: a sheet feeding member for feeding a recording material; an image recording member for recording an image on the recording material; a conveyance path connecting the sheet feeding member and the image recording member, along which the recording material is conveyed; a registration member which is provided in the conveyance path located at the upstream side of the image recording member in the conveyance direction for the recording material, and stops the leading edge of the recording material when being hit by the leading edge, and then, starts conveyance of the recording material; a loop forming member which is provided in the conveyance path located at the upstream side of the registration member in the conveyance direction for the recording material, and forms a loop on the recording material which is stopped by the registration member; a first driving source for driving the registration member; a second driving source for driving the loop forming member; and a drive control means for controlling the first driving source and the second driving source. The drive control means drives both the first driving source and the second driving source after the leading edge of the recording material hits the registration member.

Other preferable structures of the invention for attaining the first object stated above are as follows.

(Structure 1) An image forming apparatus comprising a photoreceptor on the surface of which a toner image is formed, a transfer unit which transfers a toner image formed on the surface of the photoreceptor onto a transfer sheet, a sheet feeding tray which holds the transfer sheet onto which a toner image is transferred, a registration roller which is hit by the transfer sheet fed out of the sheet feeding tray and conveys the transfer sheet to the photoreceptor, a loop forming roller which is provided at the upstream side of the registration roller to form a loop on the transfer sheet, a driving source which drives the registration roller and the loop forming roller, and a drive control means which controls the driven state of the driving source, wherein the driving source is provided independently on each of the first driving source for driving the registration roller and the second driving source for driving the loop forming roller, and when conveying a transfer sheet to the photoreceptor, the drive control means conducts control for the conveyance by driving the registration roller and the loop forming roller with the first and second driving sources.

In this Structure, a first driving source for driving a registration roller and a second driving source for driving a loop forming roller are independent from each other, and when conveying a transfer sheet to a photoreceptor, conveyance control is conducted by driving the registration roller and the loop forming roller with the first driving source and the second driving source.

Namely, since switching of conveyance speed by the loop forming roller is realized by control of the second driving source, it is not necessary to use a magnetic clutch, and dispersion and delay of response time are not caused.

(Structure 2) The image forming apparatus according to Structure 1, wherein the second driving source is one constituted with a stepping motor.

In this Structure, it is possible to switch conveyance speed easily and to control accurately.

(Structure 3) The image forming apparatus according to either one of Structure 1 and Structure 2, wherein the drive control means conducts control wherein the second driving source drives the loop forming roller by switching it to plural conveyance speeds.

Since the drive control means conducts control to switch a loop forming roller to plural conveyance speeds in this Structure, it is possible to control to switch conveyance speed of the loop forming roller, independently of a registration roller.

(Structure 4) The image forming apparatus according to Structure 3, wherein the aforesaid plural conveyance speeds represent a first conveyance speed at which a transfer sheet hits the registration roller and then forms a loop and second conveyance speed at which the transfer sheet is conveyed from the registration roller to the photoreceptor, and the first conveyance speed is different from the second conveyance speed.

In this Structure, there are the first conveyance speed at which a transfer sheet hits the registration roller and a loop is formed and the second conveyance speed at which the transfer sheet is conveyed from the registration roller to the photoreceptor, and control is conducted so that the first conveyance speed is different from the second conveyance speed. Therefore, it is possible to control to switch conveyance speed of the loop forming roller independently of the registration roller.

(Structure 5) The image forming apparatus according to Structure 4, wherein the first conveyance speed is higher than the second conveyance speed.

Since control is conducted so that the first conveyance speed at which a transfer sheet hits the registration roller and forms a loop may be higher than the second conveyance speed at which the transfer sheet is conveyed from the registration roller to the photoreceptor, in this Structure, it is possible to form images at high speed.

(Structure 6) The image forming apparatus according to either one of Structure 1–Structure 5, wherein the first driving source is one constituted with a stepping motor.

Since the registration roller is driven by the stepping motor in this Structure, it is easy to maintain and control conveyance speed, and it is possible to maintain the state of synchronization with the loop forming roller when conveying the transfer sheet to the photoreceptor.

(Structure 7) A conveyance control method for an image forming apparatus comprising a photoreceptor on the surface of which a toner image is formed, a transfer unit which transfers an toner image formed on the surface of the photoreceptor onto a transfer sheet, a sheet feeding tray which holds a transfer sheet onto which a toner image is transferred, a registration roller which is hit by a transfer sheet fed out of the sheet feeding tray and conveys the transfer sheet to the photoreceptor, a loop forming roller which is provided at the upstream side of the registration roller to form a loop on the transfer sheet, a driving source which drives the registration roller and the loop forming roller, and a drive control means which controls the driven state of the driving source, wherein the drive control means conducts conveyance control by driving the registration roller and the loop forming roller when conveying a transfer sheet to the photoreceptor, then, controls the loop forming roller so that the transfer sheet may hit the registration roller and form a loop at the first conveyance speed, and controls the loop forming roller and the registration roller so that the transfer sheet may be conveyed from the registration roller to the photoreceptor at the second conveyance speed.

In this Structure, there are the first conveyance speed at which a transfer sheet hits the registration roller and a loop is formed and the second conveyance speed at which the transfer sheet is conveyed from the registration roller to the photoreceptor, and control is conducted so that the first conveyance speed is different from the second conveyance speed. Therefore, it is possible to control to switch conveyance speed of the loop forming roller independently of the registration roller. Therefore, switching of conveyance speeds by a loop forming roller make it unnecessary to use an electromagnetic clutch, and causes neither dispersion nor delay of response time.

(Structure 8) The conveyance control method for an image forming apparatus according to Structure 7, wherein the loop forming roller is driven by a stepping motor.

In this Structure, it is possible to switch conveyance speed easily and to control accurately.

(Structure 9) The conveyance control method for an image forming apparatus according to Structure 7 or Structure 8, wherein the first conveyance speed is higher than the second conveyance speed.

It is possible to form images at high speed in this Structure because the first conveyance speed at which the transfer sheet hits the registration roller and forms a loop is controlled to be higher than the second conveyance speed at which the transfer sheet is conveyed from the registration roller to the photoreceptor.

(Structure 10) The conveyance control method for an image forming apparatus according to either one of Structure 7–Structure 9, wherein the registration roller is driven by a stepping motor.

Since the registration roller is driven by the stepping motor in this Structure, it is easy to maintain and control the conveyance speed, and it is possible to maintain the state of synchronization with the loop forming roller when conveying the transfer sheet to the photoreceptor.

(Structure 11) An image forming apparatus comprising a photoreceptor on the surface of which a toner image is formed, a transfer unit which transfers an toner image formed on the surface of the photoreceptor onto a transfer sheet, a sheet feeding tray which holds a transfer sheet onto which a toner image is transferred, a registration roller which is hit by a transfer sheet fed out of the sheet feeding tray and conveys the transfer sheet to the photoreceptor, plural conveyance paths provided at the upstream side of the registration roller to convey the transfer sheet to the registration roller, plural loop forming rollers each provided in each of the plural conveyance paths for forming a loop on the transfer sheet, a common driving source to drive the plural loop forming rollers, and a drive control means to control the driving state of the driving source, wherein the drive control means conducts control for driving each loop forming roller independently of each other by changing the direction of rotation of the driving source.

In this Structure, it is possible to drive plural loop forming rollers independently of each other by changing the direction of rotation of the common driving source. Therefore, it is not necessary to use a magnetic clutch for switching loop forming rollers to be driven and for switching the conveyance speed when plural conveyance paths exist, and neither dispersion nor delay of the response time is caused.

(Structure 12) The image forming apparatus according to Structure 11, wherein the drive control means conducts control for driving each of the loop forming rollers by switching to each of plural conveyance speeds with the driving source, so that a transfer sheet may be conveyed at its own conveyance speed which is different from others in each of the plural conveyance paths.

Since there is conducted control for switching the conveyance speed of each loop forming roller to each of plural conveyance speeds in this Structure, it is possible to control to switch the conveyance speed of each loop forming roller independently of the registration roller.

(Structure 13) The image forming apparatus according to Structure 11, wherein one of the plural conveyance paths is a conveyance path along which a transfer sheet coming from a bypass tray is conveyed.

In this Structure, there is conducted control to switch the conveyance speed of each loop forming roller to each of plural conveyance speeds, and one of them is a conveyance path from a bypass tray, which makes it possible to convey at high speed even from the bypass tray.

(Structure 14) A conveyance control method for an image forming apparatus comprising a photoreceptor on the surface of which a toner image is formed, a transfer unit which transfers an toner image formed on the surface of the photoreceptor onto a transfer sheet, a sheet feeding tray which holds a transfer sheet onto which a toner image is transferred, a registration roller which is hit by a transfer sheet fed out of the sheet feeding tray and conveys a transfer sheet to the photoreceptor, plural conveyance paths provided at the upstream side of the registration roller to convey a transfer sheet to the registration roller, plural loop forming rollers each provided in each of the plural conveyance paths for forming a loop on a transfer sheet, a driving source to drive the plural loop forming rollers, and a drive control means to control the driving state of the driving source, wherein the drive control means makes the driving source to drive plural loop forming rollers independently of each other so that a transfer sheet is conveyed along each of the plural conveyance paths.

In this Structure, the common driving source can drive plural loop forming rollers independently of each other. Therefore, it is not necessary to use a magnetic clutch for switching loop forming rollers to be driven and for switching the conveyance speed when plural conveyance paths exist, and neither dispersion nor delay of the response time is caused.

(Structure 15) The conveyance control method for an image forming apparatus according to Structure 14, wherein each loop forming roller is driven independently of each other by changing the direction of rotation of the driving source.

In this Structure, plural loop forming rollers can be driven independently of each other by changing the direction of rotation of the common driving source. Therefore, it is not necessary to use a magnetic clutch for switching loop forming rollers to be driven, and neither dispersion nor delay of the response time is caused.

Structures of the invention for attaining the second object stated above are as follows.

(Structure 16) A conveyance control method in an image forming apparatus having therein plural driving sources each driving each of plural conveyance rollers and a drive control means which switches conveyance speed for a transfer sheet under the condition that the transfer sheet is interposed between plural conveyance rollers each having a different driving source, wherein the plural driving sources represent a stepping motor, and the drive control means changes driving frequency for the stepping motor for increasing or decreasing the speed of the plural stepping motors based on the same pattern so that the stepping motors may drive rollers.

(Structure 17) An image forming apparatus having therein plural stepping motors serving as a driving source which drives each of plural conveyance rollers and a drive control means which switches conveyance speed for a transfer sheet under the condition that a transfer sheet is interposed between plural conveyance rollers each having a different driving source, wherein the drive control means conducts control to change driving frequency for the stepping motor for increasing or decreasing the speed of the plural stepping motors based on the same pattern so that the stepping motors may drive rollers.

In these Structures, each of plural conveyance rollers is driven by an independent stepping motor, and driving frequency for plural stepping motors for increasing and decreasing the speeds of the stepping motors is changed based on the same pattern so that the stepping motors may drive rollers. Therefore, two conveyance rollers which convey a transfer sheet while interposing it are in the state of synchronization with each other from the start to the stop.

It is therefore possible to realize conveyance control wherein a difference between gripping forces of two conveyance rollers and a slack of a transfer sheet are not necessary, and overload for the driving source, damage of the transfer sheet and occurrence of abnormal noise are not caused.

(Structure 18) A conveyance control method according to Structure 16, wherein the driving frequency is generated by dividing the frequency generated from the common oscillation source.

(Structure 19) The image forming apparatus according to Structure 17, wherein the drive control means has therein a common oscillation source for generating a basic clock and plural frequency dividers which divide frequency of the basic clock generated by the oscillation source and generate driving pulses which drive the plural stepping motors.

Although each of plural conveyance rollers is driven by an independent stepping motor in these Structures, the state of perfect synchronization of the conveyance rollers can be created because an oscillator is common. Due to this, two conveyance rollers which convey a transfer sheet by interposing it are in the state of perfect synchronization from the start to the stop.

It is therefore possible to realize conveyance control wherein a difference between gripping forces of two conveyance rollers and a slack of a transfer sheet are not necessary, and overload for the driving source, damage of the transfer sheet and occurrence of abnormal noise are not caused.

(Structure 20) A conveyance control method according to Structure 16 or Structure 18, wherein one of the plural conveyance rollers is a reversing conveyance roller which reverses a transfer sheet.

(Structure 21) The image forming apparatus according to Structure 17 or Structure 19, wherein one of the plural conveyance rollers is a reversing conveyance roller.

In these Structures, each of plural conveyance rollers is driven by an independent stepping motor, and one of the conveyance rollers is a reversing conveyance roller. Therefore, even in the case of sheet-reversing and sheet-refeeding in double-sided image forming, it is possible to realize conveyance control wherein a difference between gripping forces of two conveyance rollers and a slack of a transfer sheet are not necessary, and overload for the driving source, damage of the transfer sheet and occurrence of abnormal noise are not caused.

BRIEF DESCRIPTION OF THE DRAWINGS

FIGS. 9(*a*) and 9(*b*) represent illustrations showing patterns of drive frequency in operation of an image forming apparatus in another example of the invention.

DETAILED DESCRIPTION OF THE PREFERRED EMBODIMENT

An example of the invention will be explained in detail as follows, referring to FIG. 1–FIG. 6(*d*).

Incidentally, although the present example is an image forming apparatus of an electrophotographic type, the invention is not limited to this but is related to an image forming apparatus having the structure for conveying a recording sheet to the recording position such as an ink jet system.

Figure 1:
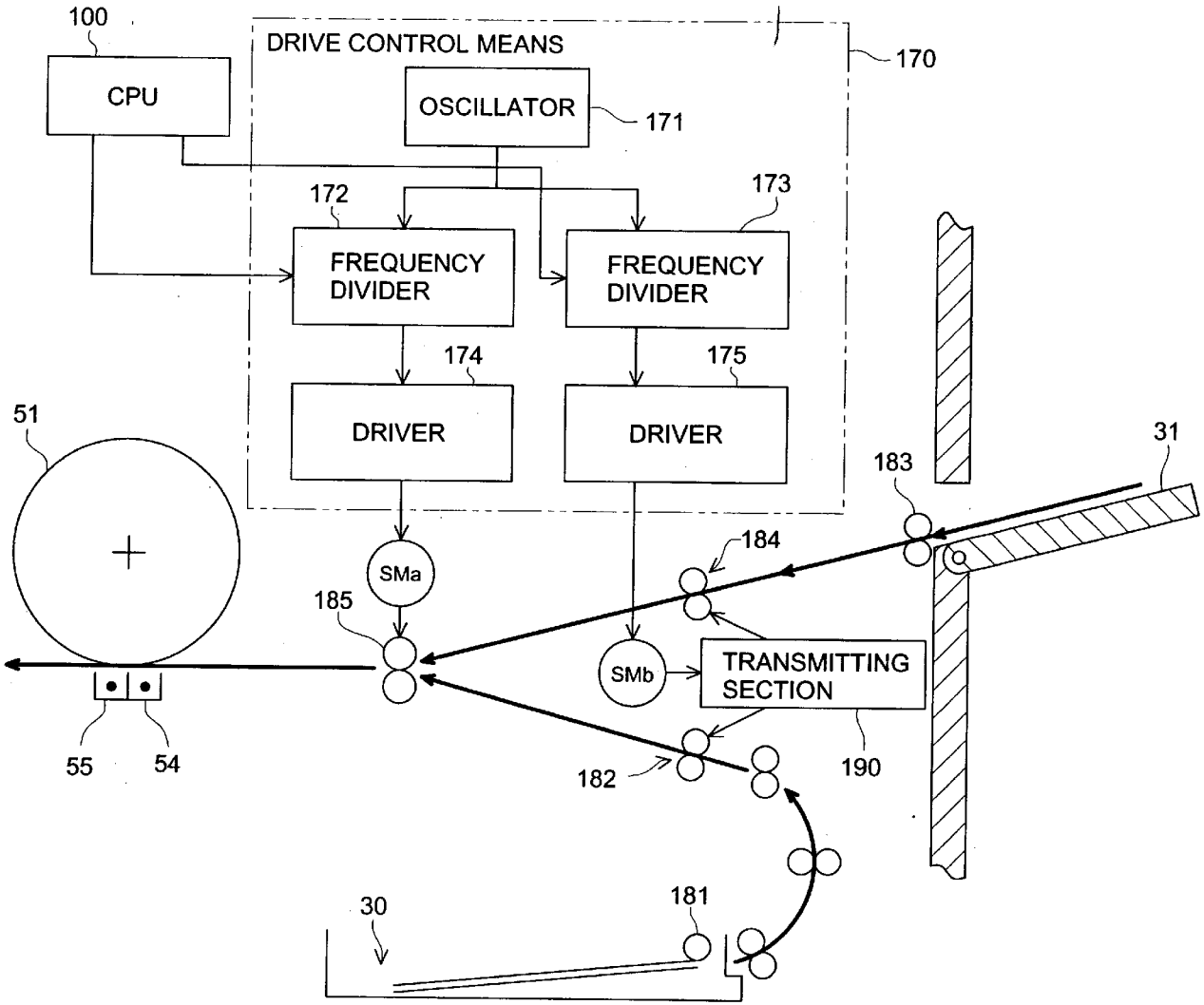
FIG. 1 is a functional block diagram showing an electric structure of primary portions of an image forming apparatus in an example of the invention.
Figure 2:
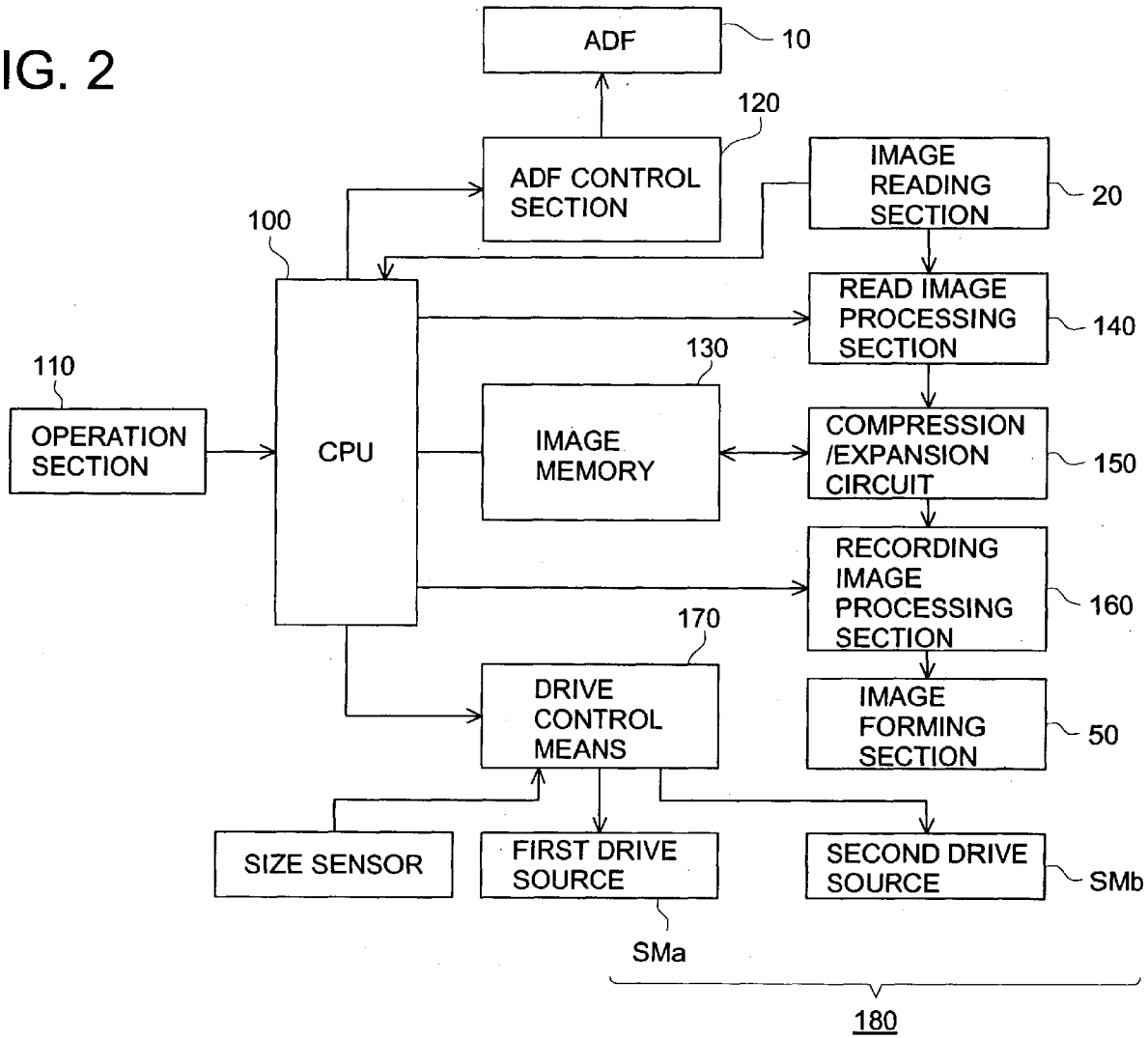
FIG. 2 is a functional block diagram showing an electric structure of the whole of an image forming apparatus in an embodiment of the invention.
Figure 3:
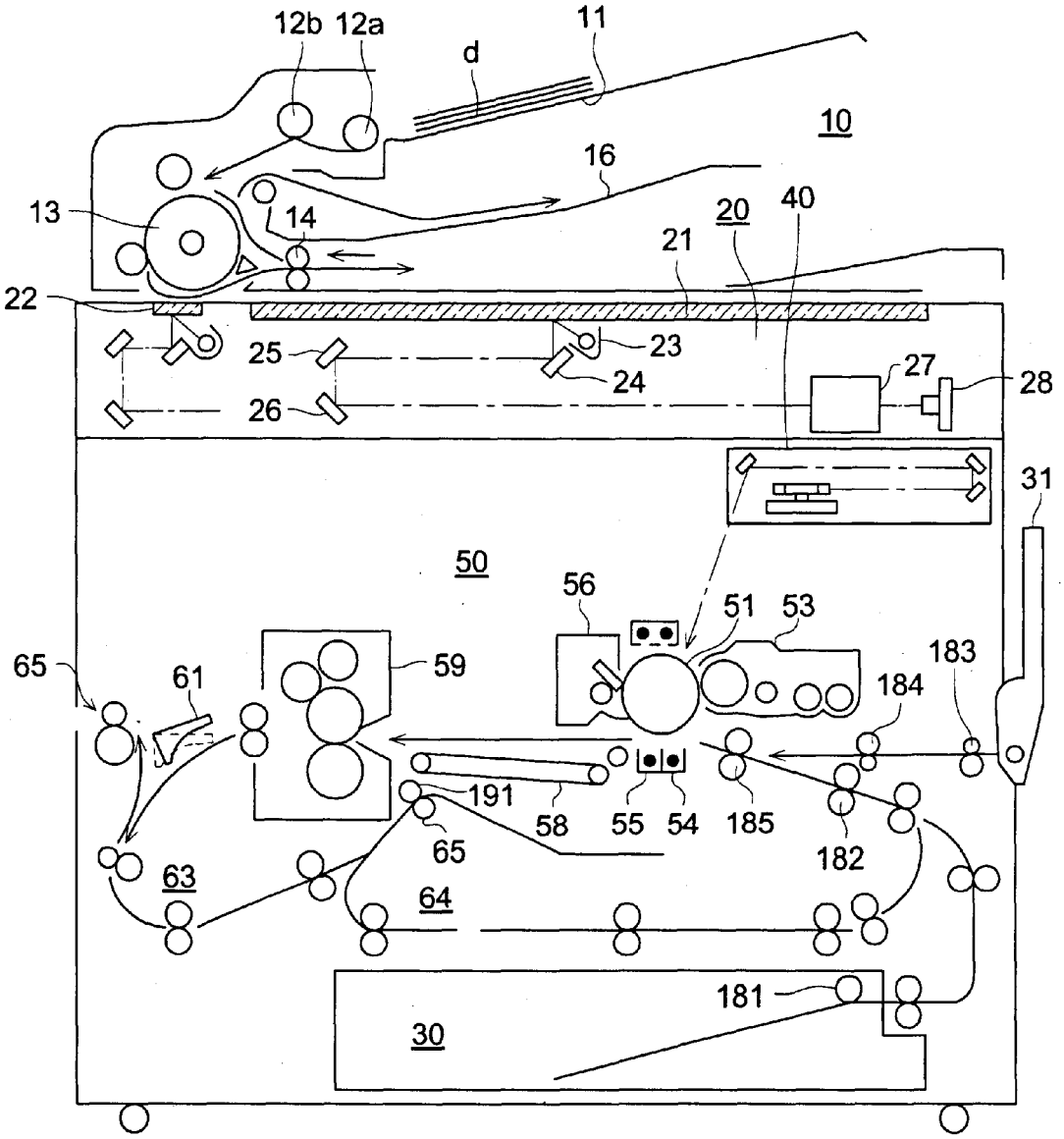
FIG. 3 is a structure diagram showing the mechanical structure of an image forming apparatus in an example of the invention.

FIG. 1 is a functional block diagram showing an example of an electric structure of primary portions of an image forming apparatus in an example of the invention. FIG. 2 is a block diagram showing a structure of the whole of an image forming apparatus in an embodiment of the invention. FIG. 3 is a sectional side view showing the mechanical structure of an image forming apparatus in an example of the invention.

The whole of an image forming apparatus will be explained as follows, referring to FIG. 2 and FIG. 3. In FIG. 2, the numeral 10 is an automatic document conveyance means (hereinafter referred to as ADF) which is a means to convey a document to read it. The numeral 20 is an image reading section where a document is read through optical scanning and image data are generated. The numeral 50 is an image forming section where the image data are recorded on recording medium (hereinafter referred to as a transfer sheet) p through an electrophotographic system.

The numeral 100 is CPU serving as a control means which controls each section, and CPU controls each section in accordance with an unillustrated processing program.

The numeral 110 is an operation section where there are conducted various operations such as selection and designation for the number of copies, enlargement ratio and reduction ratio, and transfer sheet sizes (A4, A4R, B5, B5R), and start of copying, and results of the operation are transmitted to CPU 100.

The numeral 120 is an ADF control section which controls document conveyance conducted by ADF 10, and it controls the state of document conveyance in accordance with a directive of CPU 100. The numeral 130 is an image memory acting as a memory means which stores compressed image data, and it is composed of a memory capable of storing (housing) and reading (outputting).

The numeral 140 is a read image processing section which conducts processing of image data obtained by image reading section 20 through its reading. The numeral 150 is a compression/expansion circuit which conducts compression processing for writing image data processed by the read image processing section into image memory 130 and expansion processing for expanding the compressed image data which have been read out of the image memory 130. The numeral 160 is a recorded image processing section which processes, for image forming, the image data which have been expanded and have been returned to original state.

The numeral 170 is a drive control means which controls the state of driving of a driving source which will be described later, and conducts conveyance control for a transfer sheet, while, 180 represents first and second driving sources (SMa, SMb) which drive conveyance rollers for conveying a transfer sheet based on the control conducted by the drive control means 170.

FIG. 3 is a structure diagram showing the sectional structure of an image forming apparatus used in an embodiment of the invention. In FIG. 3, on document placing section 11 of ADF 10 capable of conveying both sides of a document, there are placed plural documents "d" each being placed with its surface representing the first page facing upward. The first document fed out through roller 12*a* and roller 12*b* is conveyed through roller 13.

In this case, a document surface of document "d" is illuminated by light source 23, and its reflected light forms an image on a light-receiving surface of CCD 28 which serves as a photoelectric transfer means through mirrors 24, 25 and 26 and through image forming optical system 27. Image reading section 20 is composed of an optical system having therein light source 23, mirrors 24, 25 and 26, image forming optical system 27 and CCD 28 and of an unillustrated optical system driving means.

In FIG. 3, when document "d" which is placed on platen glass 21 with its surface to be read facing downward is read, the optical system is moved along the platen glass 21 for reading.

When reading document "d" while conveying it, the reading is conducted under the condition that light source 23 and mirror 24 are fixed under second platen glass 22. Image data of document "d" obtained through the reading are sent from CCD 28 to unillustrated read image processing section 140.

When both sides of document "d" are conveyed by ADF 10, the first page of the document "d" is read, and then, the document is reversed and conveyed again to roller 13 through reversing roller 14 so that an image on the reverse side of the document is read by image reading section 20, and image data obtained through reading are sent to read image processing section 140.

The document "d" from which an image on its surface and that on its reverse side have been read in the aforesaid manner is reversed again by reversing roller 14, and is ejected to be stacked on sheet ejection tray 16, with the surface of the document facing downward.

Image data obtained by image reading section 20 through its reading in the aforesaid manner are subjected to prescribed image processing at read image processing section 140, then are subjected to compression conducted by compression/expansion circuit 150, and are stored in image memory 130.

On the other hand, transfer sheet "p" is fed out of sheet-feeding cassette 30 wherein transfer sheets are stacked by conveyance roller 181, and is conveyed to image forming section 50. Further, transfer sheet "p" is fed out of bypass feeding tray 31 by conveyance roller 183, and is conveyed to image forming section 50.

Transfer sheet "p" conveyed to image forming section 50 is fed to the surface of photoreceptor drum 51 representing an image carrier, after being synchronized in terms of timing by registration roller 185 located in the vicinity of an entrance of the image forming section. Namely, there are provided a first conveyance path extending from sheet feeding cassette 30 to registration roller 185 and a second conveyance path extending from bypass feeding tray 31 to registration roller 185.

Image data are inputted in image writing section 40 from recorded image processing section 160, and a laser beam corresponding to the image data is applied to photoreceptor drum 51 from a laser diode in the image writing section 40 to form an electrostatic latent image. When this electrostatic latent image is developed by developing section 53, a toner image is formed on the photoreceptor drum 51.

This toner image is transferred onto transfer sheet "p" by transfer section 54 representing an image recording means located under the photoreceptor drum 51. Then, transfer sheet "p" which is in contact with the photoreceptor drum 51 is separated therefrom by separation section 55. Transfer sheet "p" separated from the photoreceptor drum 51 is conveyed by conveyance mechanism 58 and enters fixing section 59 where the toner image is fixed by heat and pressure. Thus, an image is formed on transfer sheet "p" .

Incidentally, when sheet-reversing and sheet-refeeding is needed in the case of double-sided image forming, the transfer sheet "p" on which a toner image has been fixed is conveyed downward through guide 61, and enters reversing section 63. Then, the transfer sheet "p" which has entered reversing section 63 is fed out again by reversing conveyance roller 65, and is sent to image forming section 50 again through reversing conveyance path 64. In the image forming section 50 where image forming for one side of the document "d" has been completed, toner remaining on and sticking to photoreceptor 51 is removed by cleaning section 56 to be ready for the succeeding image forming.

Under this state, the other surface (surface on which an image has not been formed yet) of the transfer sheet "p" is conveyed in image forming section 50 and an image is formed. The transfer sheet "p" separated from photoreceptor drum 51 at separation section 55 enters fixing section 59 again through conveyance mechanism 58 to be fixed. Transfer sheet "p" on which image forming on the reverse side and on the surface has been finished, or transfer sheet "p" on which image forming on one side has been finished is ejected out of the apparatus.

Details of the circumference of drive control means 170 will be explained now, referring to FIG. 1. As shown in FIG. 1, drive control means 170 is equipped with oscillator 171 which generates basic clock having prescribed frequency, frequency divider 172 which divides basic clock according to setting from CPU 100, frequency divider 173 which divides basic clock according to setting of dividing ratio from CPU 100, driver 174 which generates driving pulses for driving stepping motor SMa from frequency division signals divided by the frequency divider 172, and driver 175 which generates driving pulses for driving stepping motor SMb from frequency division signals divided by the frequency divider 173.

Incidentally, in the present embodiment, improvement of synchronization and cost reduction are realized by only one oscillator 171, which is preferable. However, it is also possible that each of driver 174 and driver 175 is provided with each oscillator.

Further, loop forming roller 182 and registration roller 185 constitute conveyance rollers for conveying by changing speed under the condition of interposing one transfer sheet. In this case, the registration roller 185 is driven by the first driving source (stepping motor SMa), while the loop forming roller 182 is driven by the second driving source (stepping motor SMb). For the purpose of realizing an independent driving source as in the foregoing, frequency divider 172 and frequency divider 173 of drive control means 170 are structured so that frequency dividing ratio of each of them is established from CPU 100 independently.

Incidentally, transmission section 190 is a means which can distribute (switch) turning force of stepping motor SMb to loop forming roller 182 closer to the first conveyance path and to loop forming roller 184 closer to the second conveyance roller. It is therefore a driving mechanism for supplying turning force to either one of conveyance rollers depending on a direction of rotation (regular direction/reverse direction) of stepping motor SMb.

As this driving mechanism, it is effective, for example, that each of conveyance rollers is provided with a one-way clutch which is opposite in terms of direction to that provided on the other conveyance roller.

Figure 4:
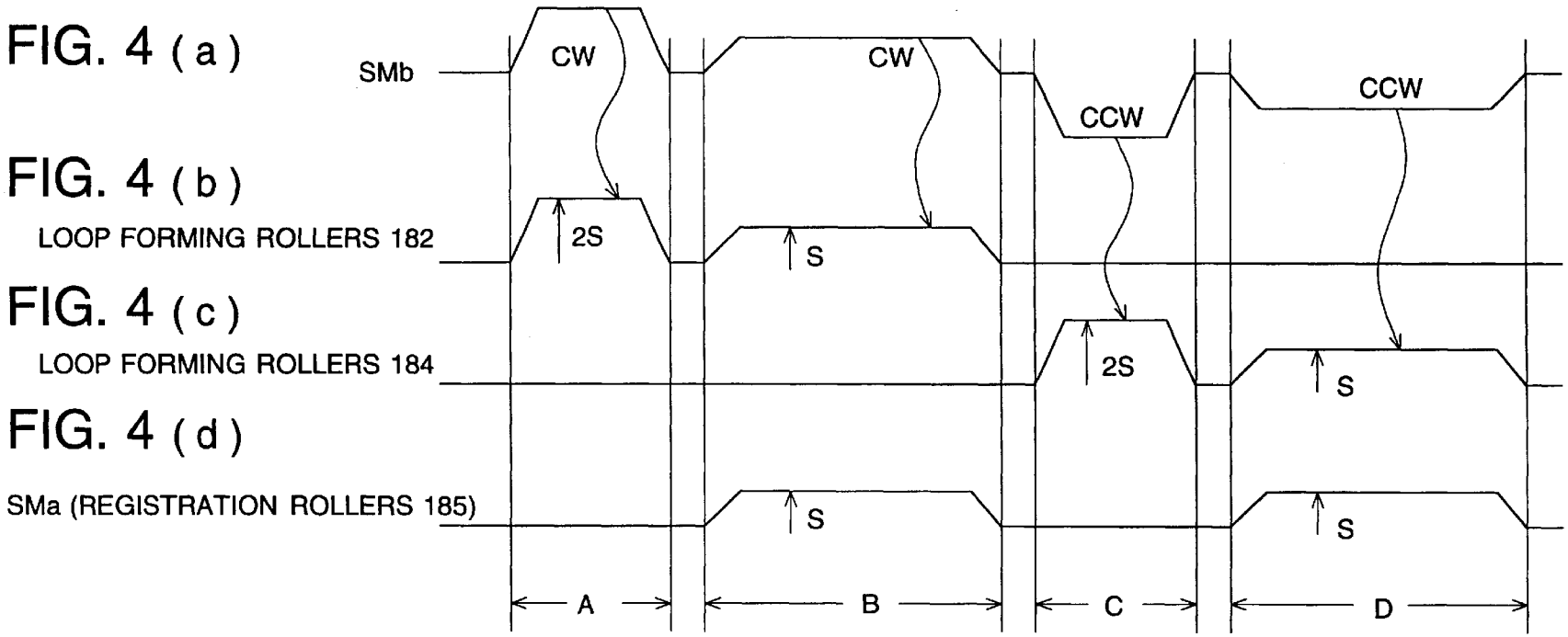
FIGS. 4(*a*)–4(*d*) represent illustrations showing patterns of drive frequency in operation of an image forming apparatus in an example of the invention.
Figure 5:
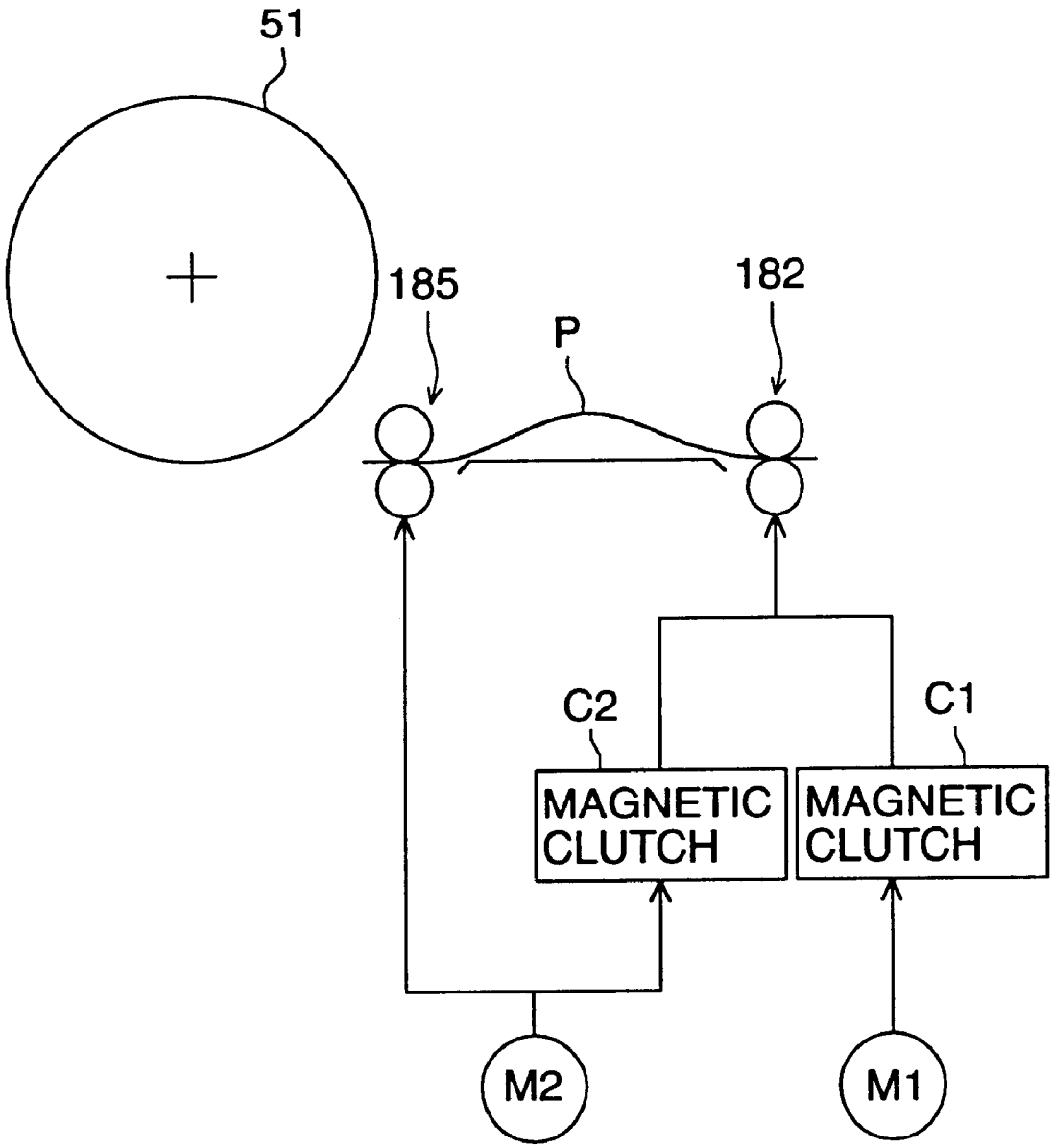
FIG. 5 PRIOR ART
FIG. 5 is an illustration showing the state in operation of a conventional image forming apparatus.
Figure 6:
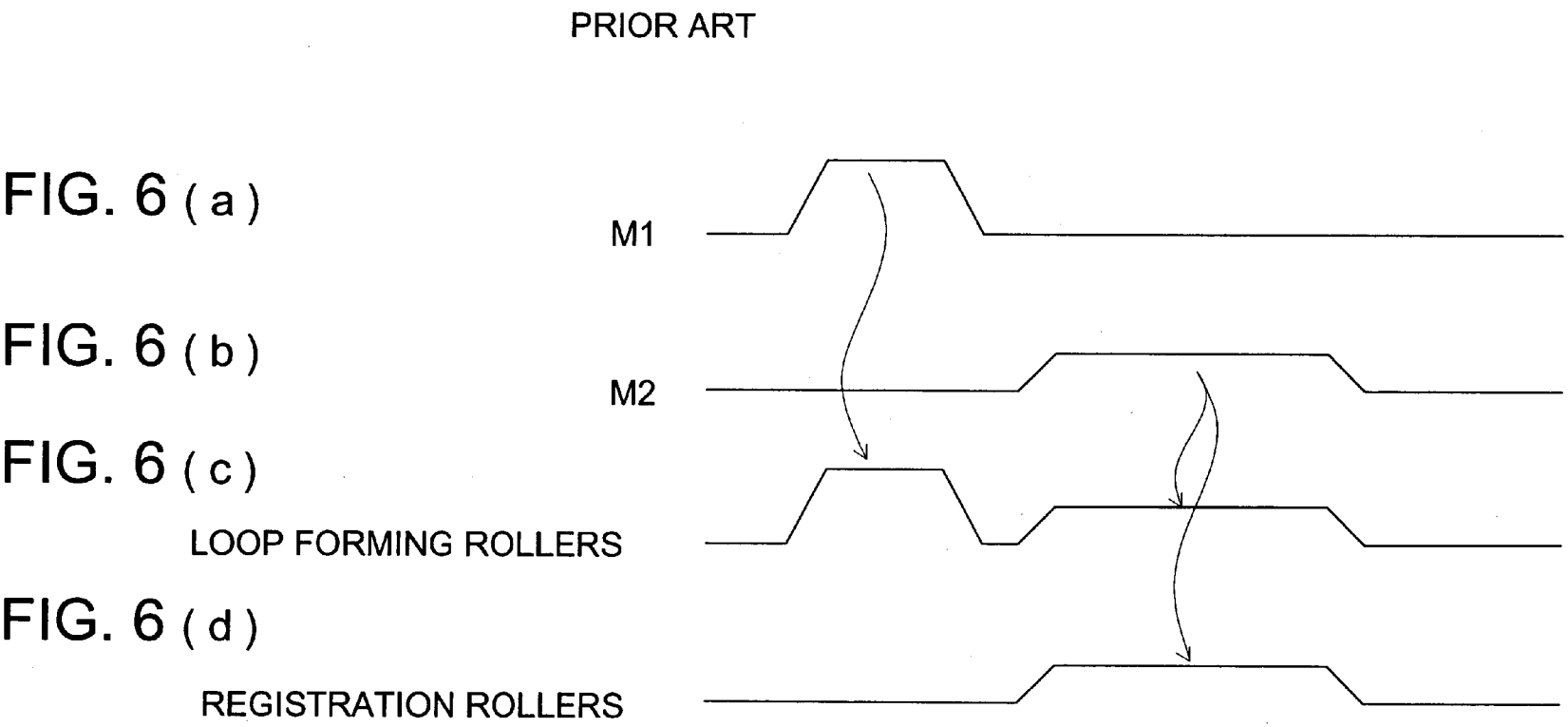
FIGS. 6(*a*)–6(*d*) represent illustrations showing the state in operation of a conventional image forming apparatus.

FIGS. 4(*a*)–4(*d*) represent characteristic diagrams showing the speed of rotation of stepping motor SMb (FIG. 4(*a*)), the conveyance speed for a transfer sheet by loop forming roller 182 (peripheral speed of loop forming roller 182: FIG. 4(*b*)), the conveyance speed for a transfer sheet by loop forming roller 184 (peripheral speed of loop forming roller 184 FIG. 4(*c*)) and the speed of rotation of stepping motor SMb (FIG. 4(*d*)). Incidentally, the speed of rotation of stepping motor SMb (FIG. 4(*d*)) corresponds to the conveyance speed for a transfer sheet by registration roller 185.

In this case, during a period of A in FIGS. 4(*a*)–4(*d*), stepping motor SMb rotates in the cw (clockwise) direction, and a rotation in this cw direction is transmitted to loop forming roller 182 through transmission section 190. Due to this, the conveyance speed of the first conveyance speed (2S) is obtained by loop forming roller 182. In this period of A, transfer sheet "p" is made to hit registration roller 185 on the part of the first conveyance path, and the transfer sheet "p" is conveyed until it forms a loop.

During a period of B in FIGS. 4(*a*)–4(*d*), stepping motor SMb rotates in the cw (clockwise) direction, and a rotation in this cw direction is transmitted to loop forming roller 182 through transmission section 190. Due to this, conveyance speed (S) is obtained by loop forming roller 182. In this period of B, stepping motor SMa is also rotating, and the second conveyance speed (S) is obtained by registration roller 185. Namely, in this period of B, transfer sheet "p" is conveyed at constant conveyance speed (S) while it is interposed between loop forming roller 182 and registration roller 185.

In the meantime, the first driving source which drives registration roller 185 and the second driving source which drives loop forming roller 182 are independent of each other, and when conveying transfer sheet "p" to photoreceptor 51, there is conducted control so that the registration roller 185 is driven by the first driving source and the loop forming roller 182 is driven by the second driving source independently of each other. Namely, since switching of the conveyance speed by the loop forming roller 182 is realized by control of the second driving source, it is not necessary to use a conventional magnetic clutch, and neither dispersion nor delay of the response time is caused.

Further, since the loop forming roller 182 is driven by the stepping motor SMb, switching between conveyance speeds (2S and S) is easy, and it is possible to control accurately.

Further, since the first driving source and the second driving source are controlled separately in drive control means 170, it is possible to control to switch the conveyance speed for loop forming roller 182 independently of registration roller 185.

Since the control to made the first conveyance speed to be different from the second conveyance speed is conducted on the part of loop forming roller 182, it is possible to control to switch the conveyance speed for loop forming roller 182 independently of registration roller 185.

Since the first conveyance speed (2S) at which the transfer sheet "p" hits registration roller 185 to form a loop is controlled to be higher than the second conveyance speed (S) for conveying from registration roller 185 to photoreceptor 51, quick conveyance of a transfer sheet can be realized, and image forming at high speed is possible.

When a stepping motor is used as a driving source not only on the part of the loop forming roller 182 but also on the part of the registration roller 185, it is easy to maintain and control the conveyance speed, and it is possible to maintain the state of synchronization with the loop forming roller 182 when conveying transfer sheet "p" to photoreceptor 51.

During a period of C in FIGS. 4(*a*)–4(*d*), stepping motor SMb rotates in the ccw (counterclockwise) direction, and a rotation in this ccw direction is transmitted to loop forming roller 184 through transmission section 190. Due to this, the conveyance speed of the first conveyance speed (2S) is obtained by loop forming roller 184. In this period of C, transfer sheet "p" is made to hit registration roller 185 on the part of the second conveyance path, and the transfer sheet "p" is conveyed until it forms a loop.

During a period of D in FIGS. 4(*a*)–4(*d*), stepping motor SMb rotates in the ccw (counterclockwise) direction, and a rotation in this ccw direction is transmitted to loop forming roller 184 through transmission section 190. Due to this, second conveyance speed (S) is obtained by loop forming roller 184. In this period of D, stepping motor SMa is also rotating, and the second conveyance speed (S) is obtained by registration roller 185. Namely, in this period of D, transfer sheet "p" is conveyed at constant conveyance speed (S) while it is interposed between loop forming roller 184 and registration roller 185.

In this case, effects obtained by independent driving between registration roller 185 and loop forming roller 184 in the period C and the period D are the same as those in the aforesaid period A and period B.

The following effects are further obtained in comparison between period A—period B and period C—period D.

In this case, a common driving source is used by plural loop forming rollers provided respectively on plural conveyance paths, and switching of the direction of rotation of this common driving source makes it possible to drive plural loop forming rollers independently of each other. Due to this, even in the case of plural conveyance paths, it is not necessary to use a magnetic clutch, and neither dispersion nor delay of the response time is caused, when switching each loop forming roller to be driven.

Since there is conducted control to switch each loop forming roller to plural conveyance speeds, it is possible to control to switch the conveyance speed of each loop forming roller independently of a registration roller.

It is also possible to make one of plural conveyance paths to be a conveyance path for conveying a transfer sheet coming from a bypass feeding tray, which makes it possible to convey at high speed also from the bypass feeding tray.

As explained in detail above, the first driving source for driving a registration roller and the second driving source for driving a loop forming roller are independent of each other in the invention, and when conveying a transfer sheet to a photoreceptor, there is conducted to control to convey by driving the registration roller with the first driving source and by driving the loop forming roller with the second driving source. Namely, since switching of the conveyance speed by the loop forming roller is realized by control of the second driving source, it is not necessary to use a magnetic clutch, and neither dispersion nor delay of the response time is caused.

In the invention, a common driving source is used by plural loop forming rollers provided respectively on plural conveyance paths, and switching of the direction of rotation of this common driving source makes it possible to drive plural loop forming rollers independently of each other. Due to this, even in the case of plural conveyance paths, it is not necessary to use a magnetic clutch, and neither dispersion nor delay of the response time is caused, when switching plural loop forming rollers to be driven and conveyance speeds.

Another example of the invention will be explained in detail as follows, referring to FIG. 7–FIG. 9(*b*).

Figure 7:
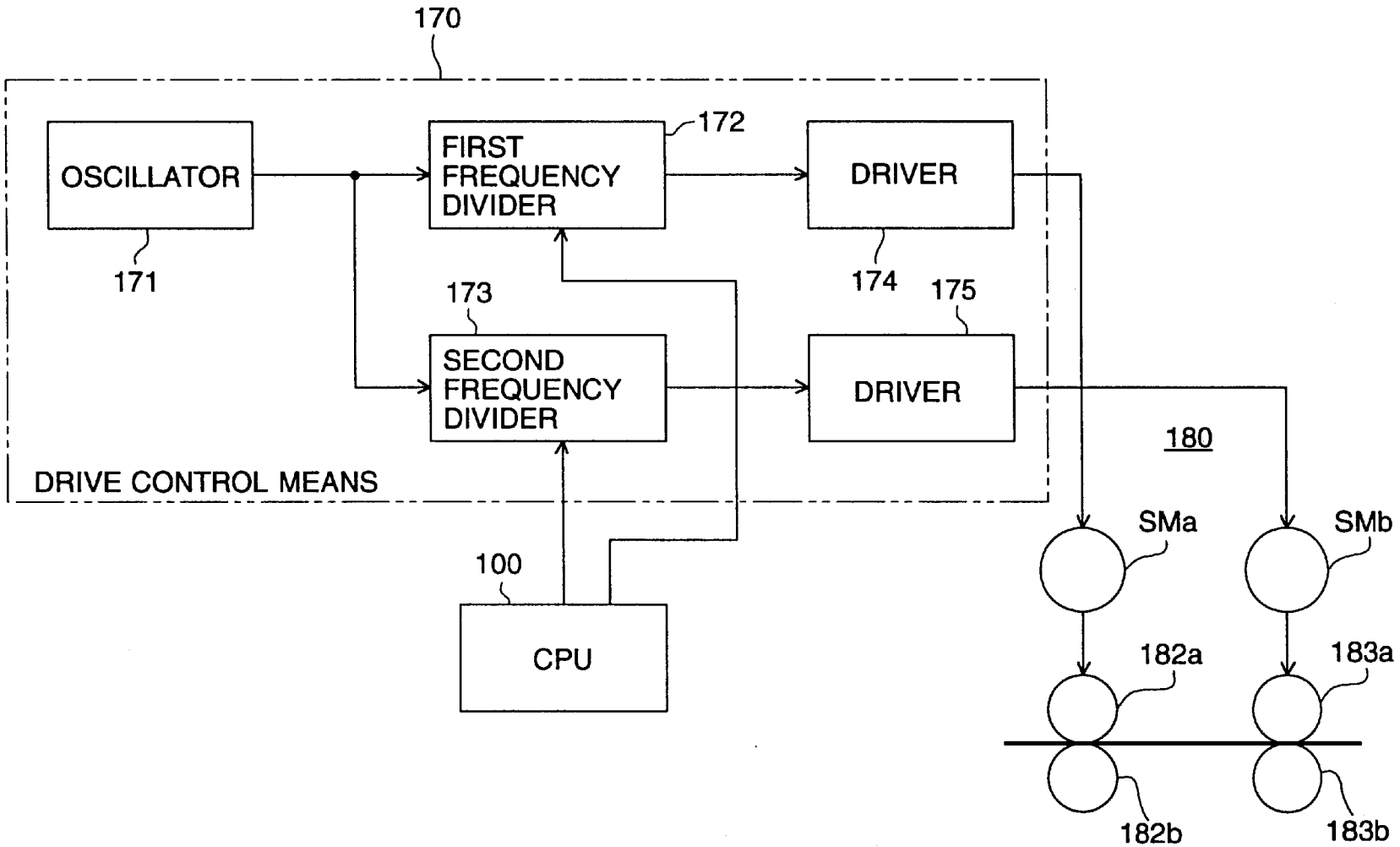
FIG. 7 is a functional block diagram showing electric structure of primary portions of an image forming apparatus in another example of the invention.
Figure 8:
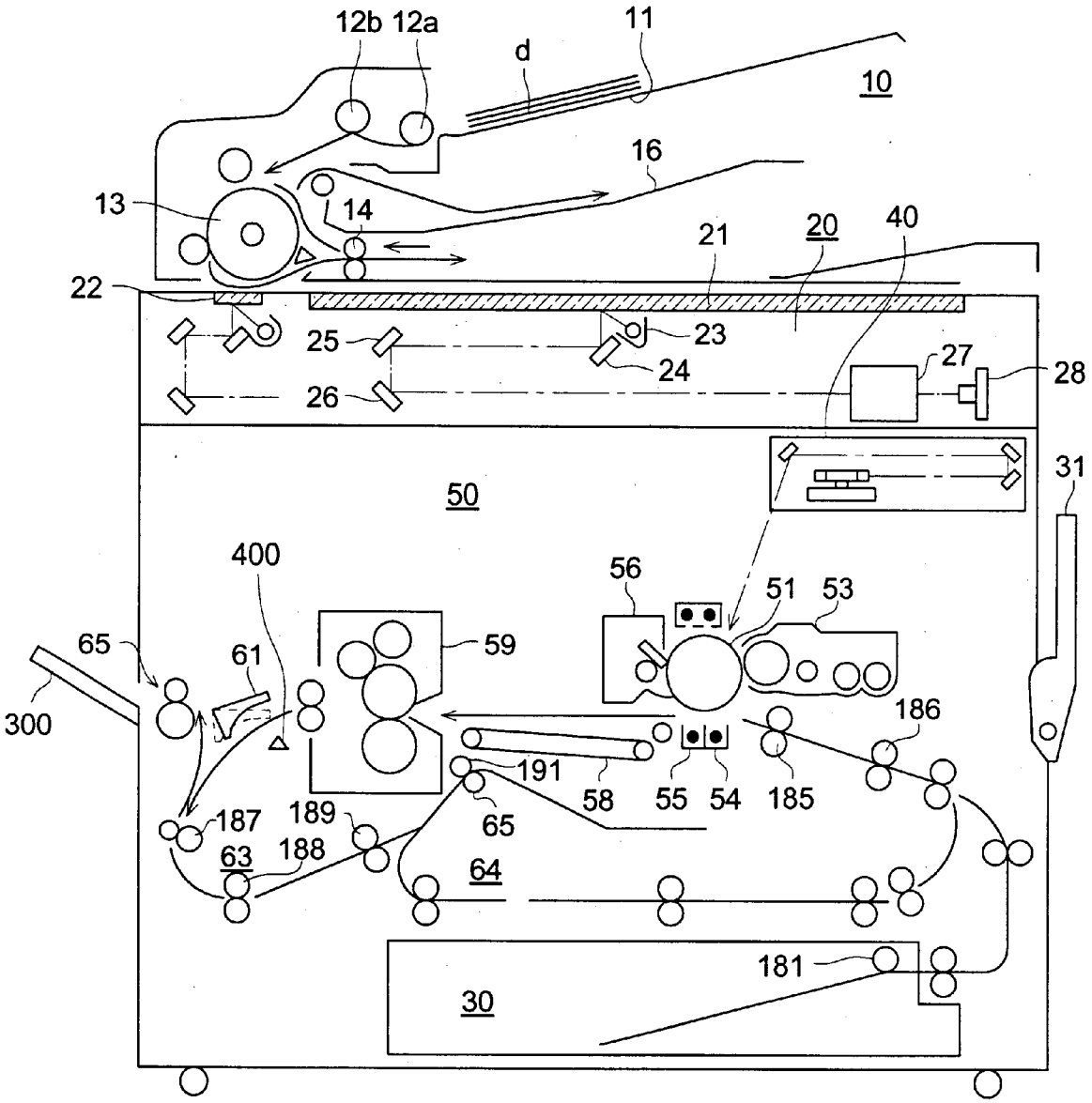
FIG. 8 is a structure diagram showing the mechanical structure of an image forming apparatus in another example of the invention.

FIG. 7 is a block diagram showing an example of electric structure of primary portions of an image forming apparatus in another example of the invention, and FIG. 8 is a sectional side view showing the mechanical structure of an image forming apparatus in another example of the invention.

The mechanical structure of another example will be explained as follows, referring to FIG. 8, focusing on the points which are different from the aforesaid example shown in FIG. 3.

Transfer sheet "p" to be conveyed to image forming section 50 is made to hit registration roller 185 located in the vicinity of the image forming section, and a loop is formed on the transfer sheet by loop forming roller 186, then, the transfer sheet is synchronized in terms of timing, and is conveyed to photoreceptor drum 51 representing an image carrier.

Conveyance roller 182*a* and conveyance roller 183*a* represent conveyance rollers which are driven respectively by different driving sources (stepping motor SMa and stepping motor SMb) to convey a transfer sheet by switching the speed under the condition that they interpose the transfer sheet. Incidentally, roller 182*b* and roller 183*b* are driven rollers which are rotated respectively by the rotations of the conveyance rollers 182*a* and 183*a*. Setting from CPU 100 for frequency dividing means setting for changing, based on the same pattern, the drive frequency in increasing and decreasing the speeds of stepping motors SMa and SMb and for making the stepping motors to drive.

FIGS. 9(*a*) and 9(*b*) represent an illustration showing patterns of drive frequency in increasing and decreasing the speeds of stepping motors SMa and SMb. Incidentally, conveyance roller 182*a* driven by stepping motor SMa and conveyance roller 183*a* driven by stepping motor SMb correspond respectively to conveyance roller 189 and reversing conveyance roller 191 both located at positions shown in FIG. 8.

A period of A in FIGS. 9(*a*) and 9(*b*) shows the state wherein transfer sheet "p" ejected out of fixing section 59 enters reversing section 63 and is conveyed toward a reversing conveyance roller. In this period A, stepping motors SMa and SMb rotate in the cw (clockwise) direction, and the transfer sheet is conveyed by conveyance roller 189 and reversing conveyance roller 191 at the second conveyance speed (s) until the trailing edge of the transfer sheet is ejected out of fixing section 59 completely.

When sensor 400 detects that the trailing edge of the transfer sheet has been ejected out of fixing section 59 completely, switching to the first conveyance speed (2 s) is conducted in the period B in FIGS. 9(*a*) and 9(*b*). In this period B, conveyance roller 189 and reversing conveyance roller 191 convey large-sized transfer sheet "p" by switching the conveyance speed under the condition that they interpose the transfer sheet. The conveyance of the transfer sheet is continued until the trailing edge of the transfer sheet "p" reaches the position immediately before the reversing roller at the first conveyance speed.

After that, in a period of C in FIGS. 9(*a*) and 9(*b*), stepping motor SMb rotates reversely in the ccw (counterclockwise) direction, and when it is rotated reversely by reversing conveyance roller 191 at the negative first conveyance speed (s), the transfer sheet "p" is reversed and conveyed. In this case, stepping motor SMa does not need to be driven, and it is stopped. However, the stepping motor SMa may also be driven together with stepping motor SMb. Then, the stepping motor SMb is stopped after the transfer sheet "p" is reversed and conveyed, to be ready for conveyance of the succeeding transfer sheet.

In this case, the first driving source for driving conveyance roller 189 and the second driving source for driving reversing conveyance roller 191 are independent of each other.

The first driving source drives conveyance rollers 187 and 188 in addition to the conveyance roller 189, thereby, conveyance rollers 187, 188 and 189 which are located at the downstream side of the fixing section and at the upstream side of the reversing conveyance roller 191 are driven by the same first driving source. This makes transfer sheet "p" to be interposed by these conveyance rollers 187, 188 and 189 in the course of switching the conveyance speed, which is preferable because troubles in conveying transfer sheet "p" in the course of switching the conveyance speed can be prevented.

Further, when reversing the transfer sheet "p" ejected out of the fixing section to eject onto a sheet ejection tray 300, it is preferable that the conveyance rollers 187–189 stated above are caused to act also as conveyance rollers when the first driving source is rotated reversely. In the case of reversing, when a transfer sheet is large in size, it is reversed and conveyed under the condition that it is interposed also by the conveyance roller 191. It is therefore possible to prevent timing delay of the transfer sheet by making the drive frequency to be the same pattern as in the example of the present embodiment.

As stated above, in the present embodiment, each of plural conveyance rollers is driven by an independent stepping motor, and driving frequency for plural stepping motors for increasing and decreasing the speeds of the stepping motors is changed based on the same pattern so that the stepping motors may drive rollers. Therefore, two conveyance rollers which convey a transfer sheet while interposing it are in the state of synchronization with each other from the start to the stop.

Though an example of applying the invention to the drive control of reversing section 63 has bee described in the present example, it is naturally possible to apply to those other than the reversing section 63. For example, the invention can be applied to drive control for a registration roller and a loop forming roller.

It is therefore possible to realize conveyance control wherein a difference between gripping forces of two conveyance rollers and a slack of a transfer sheet are not necessary, and overload for the driving source, damage of the transfer sheet and occurrence of abnormal noise are not caused.

Although each of plural conveyance rollers is driven by an independent stepping motor, the state of perfect synchronization of the conveyance rollers can be created because an oscillator is common. Due to this, two conveyance rollers which convey a transfer sheet by interposing it are in the state of perfect synchronization from the start to the stop.

Although each of plural conveyance rollers is driven by an independent stepping motor in the present embodiment, it is possible to realize conveyance control wherein a difference between gripping forces of two conveyance rollers and a slack of a transfer sheet are not necessary, and overload for the driving source, damage of the transfer sheet and occurrence of abnormal noise are not caused in the case of conveyance for sheet reversing and refeeding in double-sided image forming, even in the case that one of the plural conveyance rollers is made to be a reversing conveyance roller.

As explained in detail above, each of plural conveyance rollers is driven by an independent stepping motor in the invention, and driving frequency for plural stepping motors for increasing and decreasing the speeds of the stepping motors is changed based on the same pattern so that the stepping motors may drive rollers. Therefore, two conveyance rollers which convey a transfer sheet while interposing it are in the state of synchronization with each other from the start to the stop. Due to this, it is possible to realize conveyance control wherein a difference between gripping forces of two conveyance rollers and a slack of a transfer sheet are not necessary, and overload for the driving source, damage of the transfer sheet and occurrence of abnormal noise are not caused, in the case of conveying a transfer sheet with two conveyance rollers by switching to the different conveyance speed while the transfer sheet is interposed by these two conveyance rollers.

What is claimed is:

1. An image forming apparatus comprising:

(a) a sheet feeding member for feeding a recording material;

(b) an image recording member for recording an image on the recording material;

(c) a conveyance path connecting the sheet feeding member and the image recording member, along which the recording material is conveyed;

(d) a registration member which is provided in the conveyance path located upstream of the image recording member in a conveyance direction for the recording material, and stops a leading edge of the recording material when being hit by the leading edge, and then, starts conveyance of the recording material;

(e) a loop forming member provided in the conveyance path located up stream of the registration member in the conveyance direction for the recording material, for forming a loop on the recording material which is stopped by the registration member;

(f) a first driving source for driving the registration member;

(g) a second driving source for driving the loop forming member; and (h) a drive controller for controlling the first driving source and the second driving source, wherein the drive controller drives both the first driving source and the second driving source after the leading edge of the recording material hits the registration member, the drive controller controls the second driving source to drive the loop forming member at plural conveyance speeds by switching the second driving source, the plural conveyance speeds represent a first conveyance speed at which the recording material hits the registration member and then forms a loop and second conveyance speed at which the recording material is conveyed from the registration member to the image recording member, and the first conveyance speed is different from the second conveyance speed, and the first conveyance speed is higher than the second conveyance speed.

2. The image forming apparatus of claim 1, wherein the second driving source is constituted by a stepping motor.

3. The image forming apparatus of claim 1, wherein the first driving source is constituted by a stepping motor.

4. An image forming apparatus comprising:

(a) a sheet feeding member for feeding a recording material;

(b) an image recording member for recording an image on the recording material;

(c) a conveyance path connecting the sheet feeding member and the image recording member, along which the recording material is conveyed;

(d) a registration member which is provided in the conveyance path located upstream of the image recording member in a conveyance direction for the recording material, and stops a leading edge of the recording material when being hit by the leading edge, and then, starts conveyance of the recording material;

(e) a loop forming member provided in the conveyance path located upstream of the registration member in the conveyance direction for the recording material, for forming a loop on the recording material which is stopped by the registration member;

(f) a first driving source for driving the registration member;

(g) a second driving source for driving the loop forming member;

(h) a drive controller for controlling the first driving source and the second driving source, wherein the drive controller drives both the first driving source and the second driving source after the leading edge of the recording material hits the registration member, (i) a branching conveyance path branching from said conveyance path, which is provided upstream of the registration member in the conveyance direction for the recording material; and (j) a second loop forming member provided in the branching conveyance path, for forming a loop on a recording material which is stopped by the registration member; wherein the second driving source drives the second loop forming member, and the drive controller switches a drive of the loop forming member and the second loop forming member by changing a direction of rotation of the second driving source.

5. The image forming apparatus of claim 4, wherein the drive controller switches conveyance speed of the recording material conveyed by the loop forming member and the second loop forming member by changing a driving condition of the second driving source.

6. The image forming apparatus of claim 4 further comprising a manual feeding member, wherein the branching conveyance path is arranged so as to connect the manual feeding member with the registration member.

7. An image forming apparatus comprising:

(a) a sheet feeding member for feeding a recording material;

(b) an image recording member for recording an image on the recording material;

(c) a conveyance path connecting the sheet feeding member and the image recording member, along which the recording material is conveyed;

(d) a registration member which is provided in the conveyance path located upstream of the image recording member in a conveyance direction for the recording material, and stops a leading edge of the recording material when being hit by the leading edge, and then, starts conveyance of the recording material;

(e) a loop forming member provided in the conveyance path located upstream of the registration member in the conveyance direction for the recording material, for forming a loop on the recording material which is stopped by the registration member;

(f) a first driving source for driving the registration member;

(g) a second driving source for driving the loop forming member; and (h) a drive controller for controlling the first driving source and the second driving source, wherein the drive controller drives both the first driving source and the second driving source after the leading edge of the recording material hits the registration member, and each of the first driving source and the second driving source is constituted by a stepping motor, and the drive controller controls frequency when each stepping motor accelerates or decelerates, on the basis of a common pattern.

8. The image forming apparatus of claim 7, wherein the drive controller comprises:

an oscillation source for generating a basic clock; and a plurality of frequency divider for dividing frequency of the basic clock generated by the oscillation source and for generating a driving pulse for driving each of the stepping motors.

9. A drive control method for an image forming apparatus comprising: a sheet feeding member for feeding a recording material; an image recording member for recording an image on the recording material; a conveyance path connecting the sheet feeding member and the image recording member, along which the recording material is conveyed; a registration member which is provided in the conveyance path located upstream of the image recording member in a conveyance direction for the recording material, and stops a leading edge of the recording material when being hit by the leading edge, and then, starts conveyance of the recording material; and loop forming member provided in the conveyance path located upstream of the registration member in the conveyance direction for the recording material, for forming a loop on the recording material which is stopped by the registration member; a first driving source for driving the registration member; a second driving source for driving the loop forming member; and a drive controller for controlling the first driving source and the second driving source, wherein the drive controller controls the second driving source to drive the loop forming member so that a loop is formed on the recording material by hitting the leading edge of the recording material to the registration member at a first conveyance speed, and controls the first driving source and the second driving source so that the recording material is conveyed by the registration member and the loop forming member at a second conveyance speed, and the first conveyance speed is arranged to be higher than the second conveyance speed said drive control method comprising the steps of:

(a) hitting the leading edge of the recording material to the registration member; and (b) then driving both the first driving source and the second driving source.

10. A drive control method for an image forming apparatus comprising: a sheet feeding member for feeding a recording material; an image recording member for recording an image on the recording material; a conveyance path connecting the sheet feeding member and the image recording member, along which the recording material is conveyed; a registration member which is provided in the conveyance path located upstream of the image recording member in a conveyance direction for the recording material, and stops a leading edge of the recording material when being hit by the leading edge, and then, starts conveyance of the recording material; a loop forming member provided in the conveyance path located upstream of the registration member in the conveyance direction for the recording material, for forming a loop on the recording material which is stopped by the registration member; a first driving source for driving the registration member; a second driving source for driving the loop forming member; a drive controller for controlling the first driving source and the second driving source, a branching conveyance path branching from said conveyance path, which is provided upstream of the registration member in the conveyance direction for the recording material; and a second loop forming member provided in the branching conveyance path, for forming a loop on a recording material which is stopped by the registration member, and the second driving source driving the second loop forming member, wherein the second driving source drives the second loop forming member, and the drive controller switches a drive of the loop forming member and the second loop forming member by changing a direction of rotation of the second driving source, said drive control method comprising the steps of:

(a) hitting the leading edge of the recording material to the registration member;

(b) then driving both the first driving source and the second driving source.

11. The drive control method of claim 10, wherein the loop forming member is arranged to be driven by a stepping motor.

12. The drive control method of claim 10, wherein the registration member is arranged to be driven by a stepping motor.

13. A drive control method for an image forming apparatus comprising: a sheet feeding member for feeding a recording material; an image recording member for recording an image on the recording material; a conveyance path connecting the sheet feeding member and the image recording member, along which the recording material is conveyed; a registration member which is provided in the conveyance path located upstream of the image recording member in a conveyance direction for the recording material, and stops a leading edge of the recording material when being hit by the leading edge, and then, starts conveyance of the recording material; a loop forming member provided in the conveyance path located upstream of the registration member in the conveyance direction for the recording material, for forming a loop on the recording material which is stopped by the registration member; a first driving source for driving the registration member; a second driving source for driving the loop forming member; and a drive controller for controlling the first driving source and the second driving source, wherein each of the first driving source and the second driving source is arranged to be structured by a stepping motor, and the drive controller controls frequency when each stepping motor accelerates or decelerates, on the basis of a common pattern, said drive control method comprising the steps of:

(a) hitting the leading edge of the recording material to the registration member; and (b) then driving both the first driving source and the second driving source.

14. The drive control method of claim 13, wherein the drive controller is arranged to comprise:

an oscillation source for generating a basic clock; and a plurality of frequency divider for dividing frequency of the basic clock generated by the oscillation source and for generating a driving pulse for driving each of the stepping motors.

* * * * *